United States Patent [19]

Stanislaw

[11] 4,058,812

[45] Nov. 15, 1977

[54] DISH ANTENNA WITH IMPEDANCE MATCHED SPLASH PLATE FEED

[75] Inventor: David L. Stanislaw, Hatfield, Pa.

[73] Assignee: Aradar Corporation, Ambler, Pa.

[21] Appl. No.: 682,766

[22] Filed: May 3, 1976

[51] Int. Cl.[2] ..... H01Q 19/14

[52] U.S. Cl. ..... 343/761; 343/781 P

[58] Field of Search ..... 343/772, 781, 781 P, 343/840, 761, 784

[56] References Cited

U.S. PATENT DOCUMENTS

| | | | |
|---|---|---|---|
| 2,455,286 | 11/1948 | Werner | 343/781 P |
| 2,505,424 | 4/1950 | Moseley | 343/786 |
| 2,632,852 | 3/1953 | Sichak | 343/772 |
| 2,829,366 | 4/1958 | Armstrong et al. | 343/781 P |
| 2,989,748 | 6/1961 | Doundoulakis et al. | 343/781 P |

*Primary Examiner*—Eli Lieberman

*Attorney, Agent, or Firm*—Paul & Paul

[57] ABSTRACT

A directional microwave antenna system comprising a concave reflector fed by a wave guide and splash plate assembly. Two rectangular apertures in the wave guide at the focus of the reflector admit energy to and from the splash plate. Impedance matching tabs protrude into the rectangular apertures to match the antenna system. Rectangular tabs provide improved VSWR, high side-lobe reduction with the reflector on-axis. Circular tabs provide improved VSWR and good side-lobe reduction with the reflector on or off axis.

5 Claims, 7 Drawing Figures

CUTLER FEED WITH TUNING STUB

STANDARD CUTLER FEED

DISH ANTENNA WITH IMPEDANCE MATCHED SPLASH PLATE FEED

BACKGROUND OF THE INVENTION

I. Field of the Invention

This invention relates to directional microwave antenna systems and more particularly to a radar antenna system for use with an airborne radar. The antenna system comprises a parabolic dish reflector fed by a wave guide having two apertures and a splash plate positioned at the focus of the reflector. The antenna system produces a pencil beam which can be steered in azimuth and elevation by displacement of the parabolic reflector.

II. Description of the Prior Art

Directional microwave antenna systems such as that disclosed in U.S. Pat. No. 2,422,184 provide a pencil beam antenna pattern particularly adapted for use in airborne radar systems. These prior art systems comprise a parabolic reflector fed by a wave guide having apertures and a splash plate positioned at the focus of the reflector. The beams of these prior art antenna systems can be steered by movement of either the feed or the reflector or by pointing the entire antenna assembly. These systems are particularly useful in airborne systems where space is at a premium and where it is desirable to mount the radar antenna behind a radome.

Antenna systems used with airborne radars usually employ a relatively narrow beam to achieve high resolution. Because the magnetron transmitting tubes used with such radar systems are sensitive to reflected energy, the radar antenna system should reflect little energy, i.e. the voltage standing wave ratio (VSWR) of the antenna should be low. The side and back lobes of the radar antenna pattern must be maintained as low as possible, at least 20 db down, to avoid false target ambiguities.

The directional microwave antenna system disclosed in U.S. Pat. No. 2,422,184 to Cutler has, with some variations, been widely used in airborne radar antenna systems. This standard Cutler Cutler has a relatively high VSWR and thus reflects considerable energy back into the magnetron of the radar system. This reflected energy poses substantial design constraints because the radar system's automatic frequency control circuitry must be able to maintain lock with the desired signal in the presence of random-phase interfering reflected signals.

To overcome the reflected energy difficulties associated with the standard Cutler feed, it has been common practice to tune the antenna system by inserting tuning stubs in the wave guide of the antenna. The positioning of these tuning stubs is frequency sensitive and thus while the tuned Cutler feed system represents an improvement of the standard Cutler feed at a specific frequency, the system is very narrow-band. Further, there is a variation in the overall reflected power of the system as the parabolic reflector is moved from one position to another. This variation is exhibited by all Cutler feed antennas but is particularly pronounced for the stub-tuned Cutler feed.

SUMMARY OF THE INVENTION

The directive microwave antenna of the present invention incorporates impedance matching tabs in the feed mechanism of the antenna system which eliminates the high variations in reflected power exhibited by the standard Cutler antenna and the tuned Cutler antenna, thus providing an antenna system particularly adapted for use in airborne radar systems. Two configurations of the impedance matching tab are disclosed. A square impedance matching tab exhibits a VSWR of better than 1.22 to 1, excellent side-lobe performance with the beam dead ahead, but poor side-lobe performance with the beam off-axis. A circular tab exhibits a VSWR of better than 1.22 to 1 and has adequate side-lobe performance with the beam either dead ahead or up to 45° off-axis.

It is therefore an object of this invention to provide a directive microwave antenna system particularly suited for use in airborne radar applications.

It is another object of this invention to provide a directional microwave antenna system with a low voltage standing wave ratio.

It is another object of this invention to provide a directional mircowave antenna system whose side-lobe performance can be easily optimized for use with a scanning or fixed parabolic reflector.

It is another object of this invention to provide a directional microwave antenna system for use with a tuneable radar system.

BRIEF DESCRIPTION OF THE DRAWINGS

The novel features of this invention as well as the invention itself, both as to its method of organization and method of operation, will best be understood from the accompanying description, taken in connection with the accompanying drawings in which like reference characters refer to like parts, and in which.

DESCRIPTION OF THE PREFERRED EMBODIMENT

Figure 1:
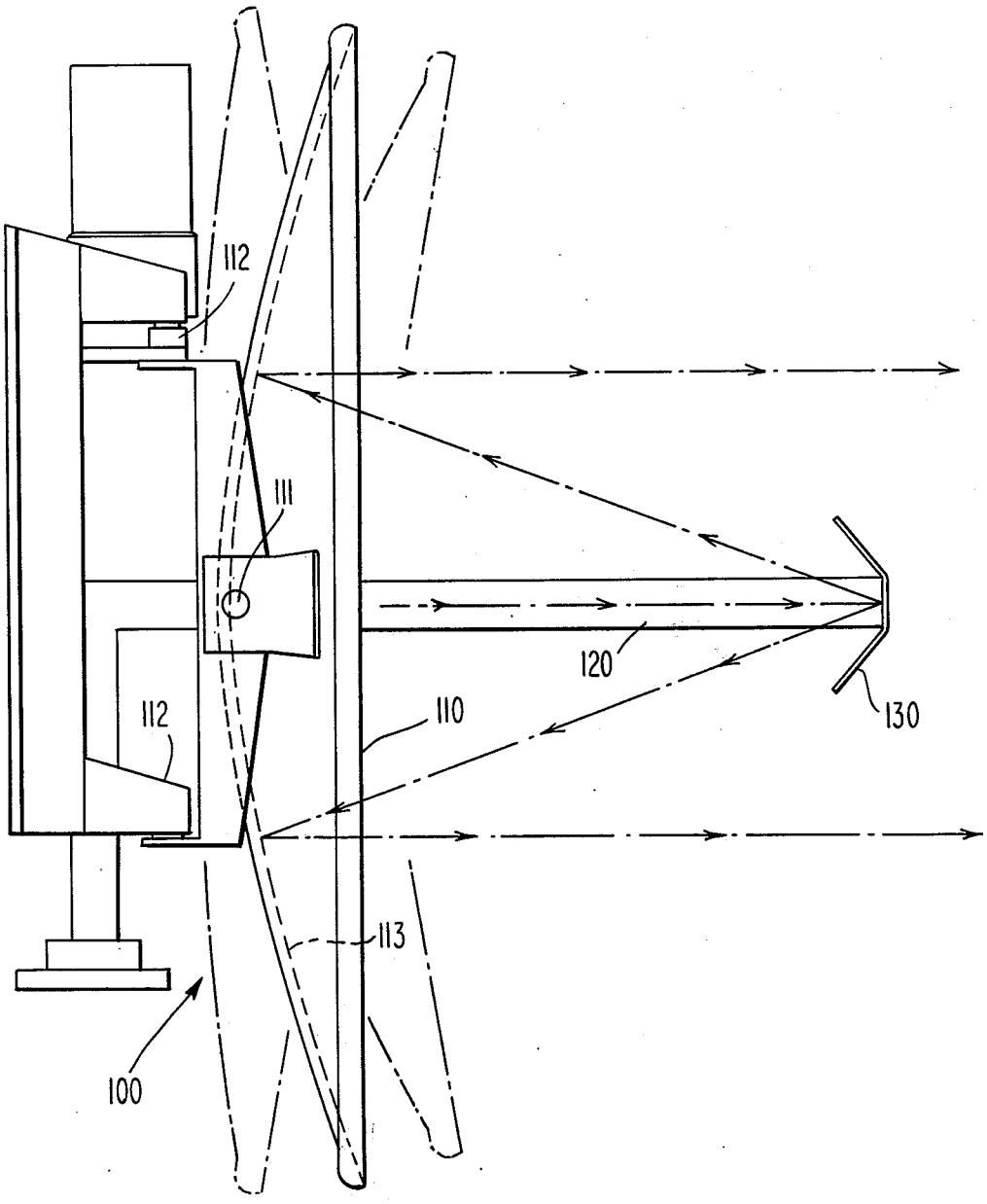
FIG. 1 is a schematic illustration of the antenna system showing the parabolic reflector, the wave guide and splash plate.

FIG. 1 is a side view of the radar antenna assembly 100 comprised of a parabolic reflector 110 a wave guide 120 a splash plate 130. The parabolic reflector 110 can be pivoted about pivot point 111 to scan the radar beam in elevation, and about pivot points 112 to scan the radar beam in azimuth.

Energy from the radar transmitter is coupled to the antenna and travels down wave guide 120 where it impinges upon radar splash plate 130 which directs the energy rearwards to the inner surface 113 of the parabolic reflector 110. Received energy reflecting from targets impinges upon parabolic reflector 110 and is focused back towards the splash plates 130 and thence along wave guide 130 to the radar receiver. Apertures 140 in wave guide 120 located in close proximity to radar splash plate 130 allow the energy to pass through the top and bottom of wave guide 120 as shown. These apertures are shown in detail in FIGS. 3 and 4.

Figure 2:
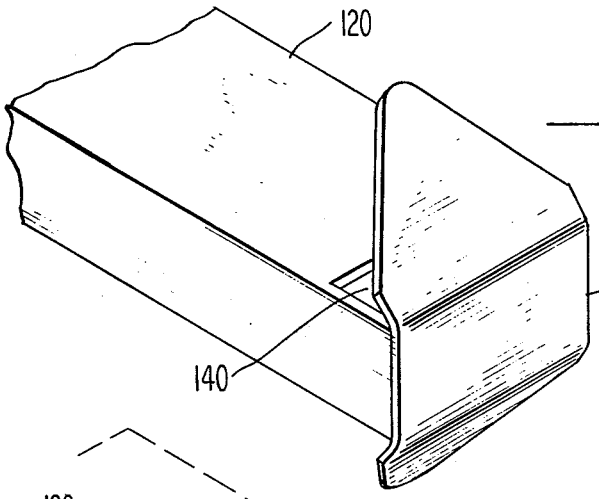
FIG. 2 is a perspective illustration of the end of the wave guide with the splash plate attached.

FIG. 2 is a perspective view of the end of wave guide 120 with splash plate 130 attached.

Figure 3:
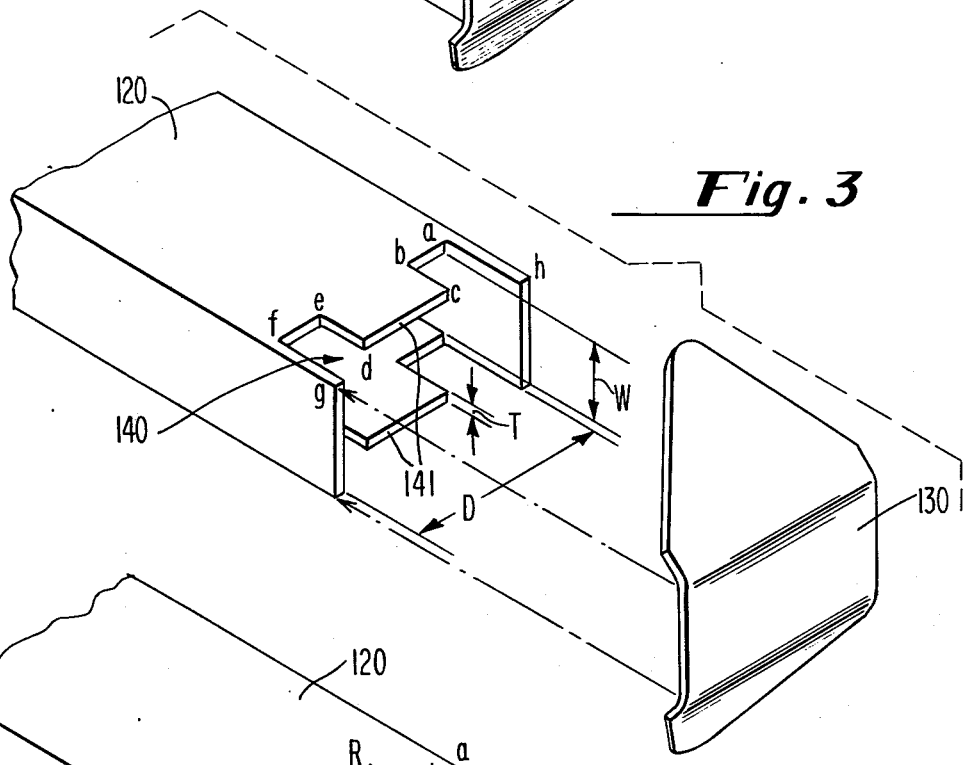
FIG. 3 is an exploded view of the end of the wave guide showing the apertures and rectangular impedance matching tabs.

FIG. 3 is a detailed view of the end of wave guide 120 showing two identical apertures 140 and matching tabs 141. The relative dimensions of the components of this system are a function of the frequency of the radar system. Typically, airborne radars operate at X-band centered at 9375 MHz. Rectangular wave guide for use at this frequency has interior dimensions of approximately 0.40 inches by 0.90 inches, shown as W and D respectively in FIG. 3. The rectangular matching tab of this invention is labeled *bcde* in FIG. 3. Identical tabs are used in each aperture, 140. Representative dimensions for this rectangular tab for use with an X-band radar are as follows:

$$bc = ed = 0.20 \text{ inch}$$

$$cd = be = 0.50 \text{ inch}$$

$$ha = gf = 0.40 \text{ inch}$$

$$hg = af = 0.90 \text{ inch}$$

The rectangular tab *bcde* is positioned along the centerline of side *af* of aperture *hafg* as shown.

Figure 4:
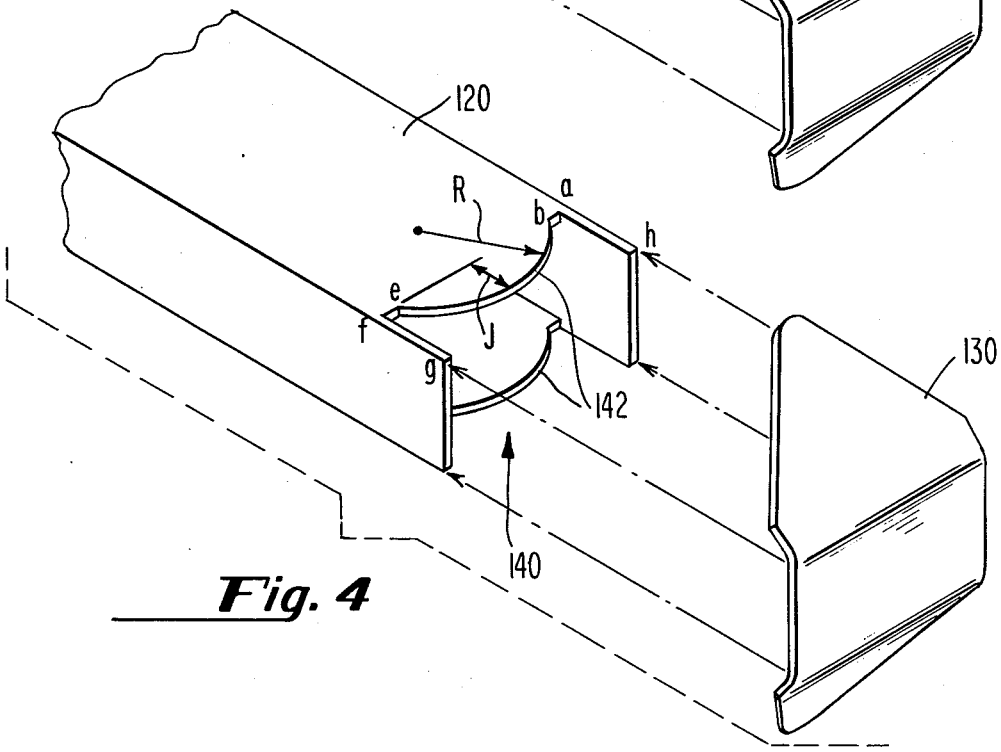
FIG. 4 is another exploded view of the end of the wave guide illustrating circular matching tabs.

FIG. 4 illustrates a circular version of the impedance matching tab of this invention. The radius of the circular tab R is greater than the perpendicular distance *j* that circular tabs 142 extend into apertures 140, so that the circular tab is less than a semicircle. The interior dimensions of wave guide 120 depicted in FIG. 4 are identical to the wave guide dimensions of the wave guide in FIG. 3, as are the dimensions of aperture *hafg*. Perpendicular distance *j* is 0.20.

Of course, the dimensions and relationships given above for the rectangular and circular tabs are representative but not exhaustive. The circular tab could be semicircular, or somewhat flatter than shown, and the lengths of side *ab* and *ef* of FIGS. 3 and 4 can be varied.

Figure 5:
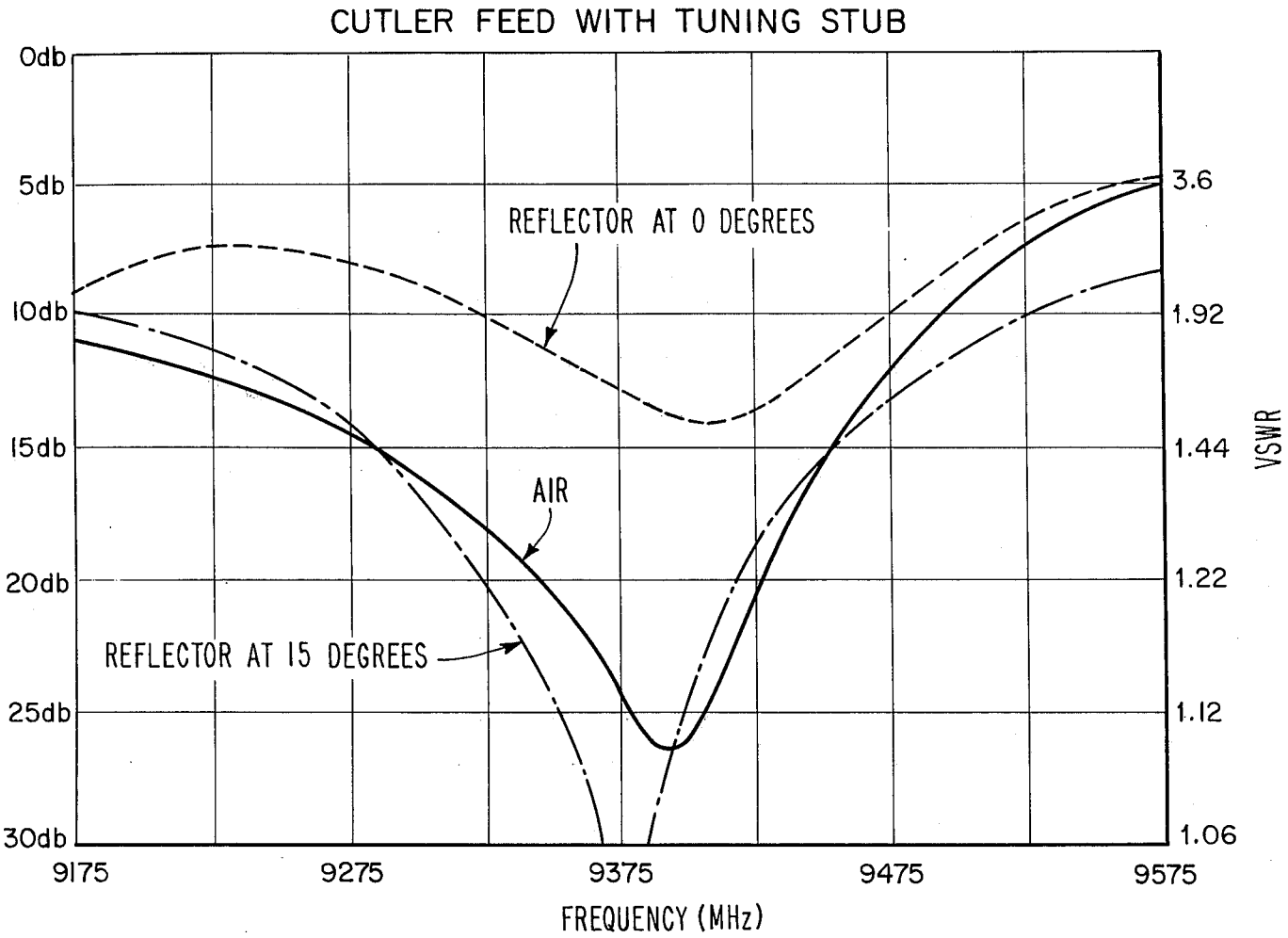
FIG. 5 is a graphical representation of the Cutler feed with tuning stub showing the variation in VSWR as the frequency is varied from 9175 MHz to 9575 MHz.

FIG. 5 shows a similar relationship between the VSWR and frequency for a Cutler feed with tuning stub. The tuning stub is quite frequency sensitive but does effectively reduce reflected power at the center frequency. However, the reflected power from the tuned Cutler antenna system varies substantially as the parabolic reflector is moved from 0° to 15° off-axis. At a frequency of 9375 MHz, the reflected energy is 13 db down with the reflector at 0° and more than 30 db down when the reflector is at 15°. Again, assuming an input power of 7 kilowatts, this amounts to a change in reflected power of 350 watts as the antenna scans. The phase of this reflected energy is random, accordingly this energy poses a significant constraint in the design of the atuomatic frequency control circuits of the radar.

Figure 6:
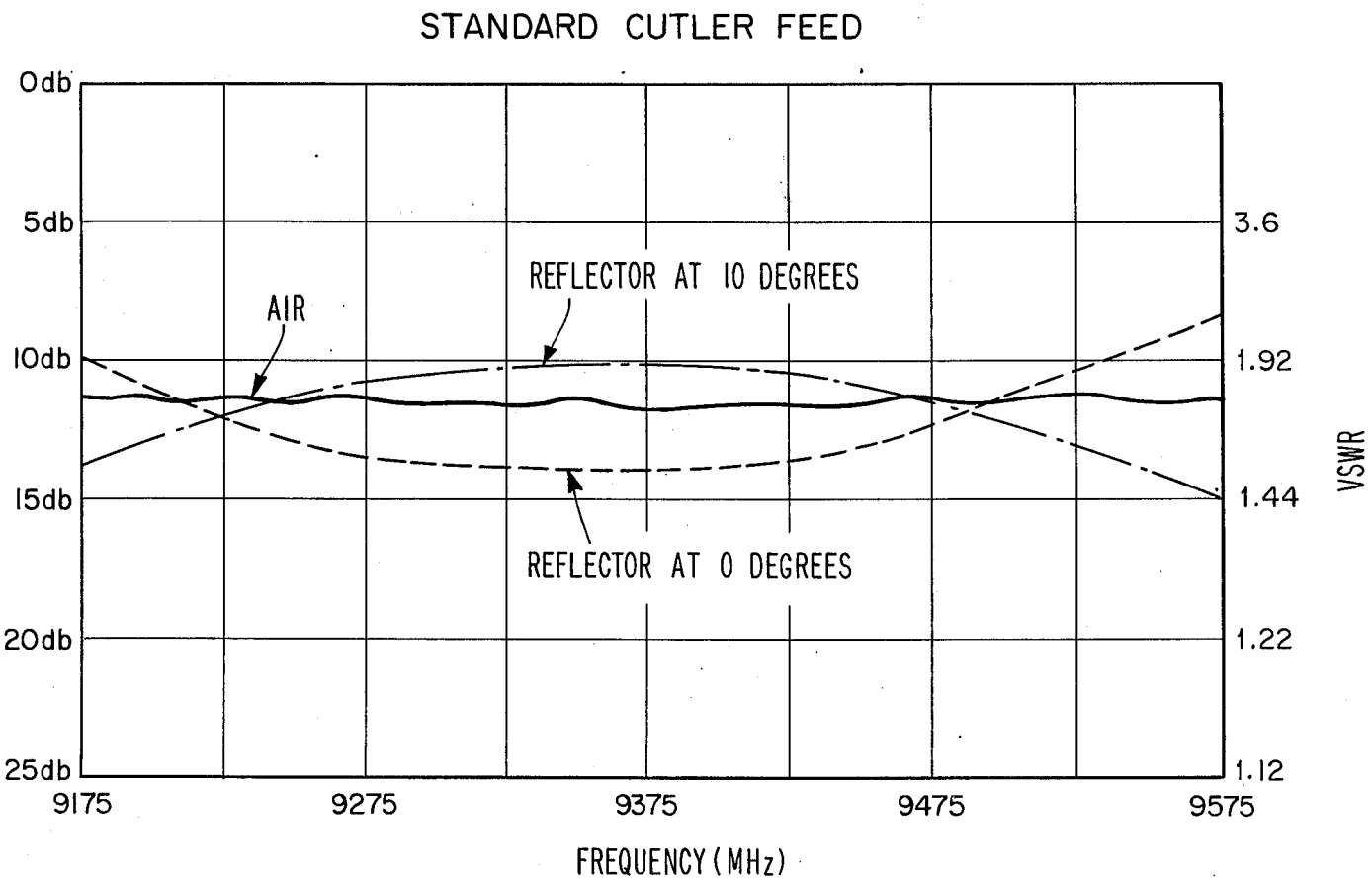
FIG. 6 is a graphical representation of the standard Cutler feed showing the variation in VSWR as the frequency is varied from 9175 MHz to 9575 MHz.

FIG. 6 illustrates the variation in VSWR of a standard Cutler feed as the frequency is varied from 9175 MHz to 9575 MHz. Three separate plots are given. The plot labeled "air" depicts the VSWR of the wave guide portion of the antenna system with no parabolic reflector installed. The other two plots illustrate the VSWR of the system with the reflector oriented on-axis (the orientation corresponding to the lowest VSWR), and off-axis at an orientation that produced the highest VSWR. The db numbers listed on the left side of the graph indicate the amount of attenuation of reflected power with respect to input power. For example, with the reflector at 10° and a frequency of 9375 MHz the reflected power will be 10 db below the input power. A db can be defined as follows:

$$db = 10\text{Log}_{10} \frac{P_{reflected}}{P_{in}}$$

A representative input power for an airborne pulse radar system is 7 kilowatts. Under the conditions described above, reflected power would be 10 db down or would amount to 700 watts.

Figure 7:
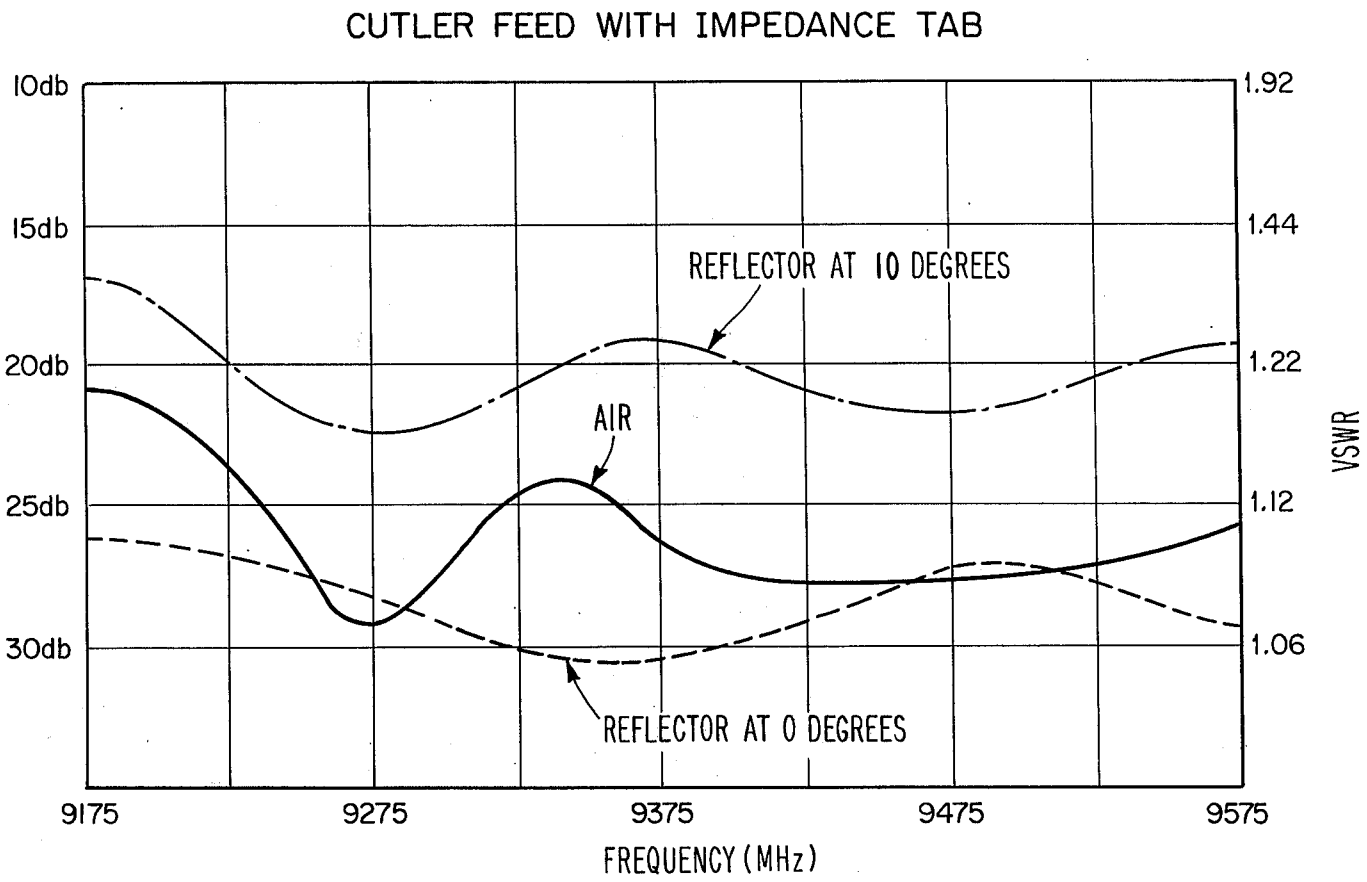
FIG. 7 is a graphical representation of the Cutler feed with impedance matching tabs showing the variation in VSWR as the frequency is varied from 9175 MHz to 9575 MHz.

FIG. 7 illustrates VSWR response of an antenna assembly employing the matching impedance tabs of the present invention (either rectangular or circular). As shown, the response of the impedance matching tabs is fairly broadband and achieves a low VSWR for all frequencies between 9175 MHz and 9575 MHz for reflector positions of 0° to 10°. At a frequency of 9375 MHz the reflected power is approximately 30 db down with the reflector at 0° and 19 db down with the reflector at 10°. This corresponds to a change in reflected power of 87.5 watts for a 7 kilowatt system, as the antenna scans. With the reflector on-axis, the VSWR is less than 1.12 to 1 over a frequency range of 4 percent of the design frequency of the antenna assembly—a significant improvement over prior art antenna assemblies.

The reflected power characteristics of the rectangular and circular matching tabs are essentially identical. However, there is one significant difference in the performance of the two configurations. The rectangular tab gives poor side lobe attenuation when the reflector is rotated off-axis to steer the beam, but good attenuation when the reflector is on-axis. The circular tab has adequate side-lobe attenuation for all typical reflector positions.

It is believed that the corners of the rectangular tab, points *c* and *d* of FIG. 3, act as independent radiators, thus the phase control fore and aft is excellent but off-axis phase control is poor. This off-axis multiphase wave creates cycles of side lobes as the parabolic reflector is moved to steer the beam.

In a typical system the reflector is moved through an arc of plus or minus 22½° to steer the beam a total of plus or minus 45 degrees. In applications where it is not necessary to steer the beams through a significant arc, the rectangular tab provides a good VSWR over a broad band of frequencies.

For applications where it is necessary to steer the beam through a significant arc, it is preferable to use the circular impedance matching tab. This maintains a good VSWR while degrading the side lobe performance for the parabolic reflectors dead ahead but increasing the side lobe performance with the parabolic reflector off-axis.

A summary of the characteristics of the two configurations of impedance matching tabs is as follows:

| | SQUARE TAB | CIRCULAR TAB |
|---|---|---|
| VSWR | better than 1.22:1 | better than 1.22:1 |
| Side lobe performance with a parabolic reflector: Dead ahead | excellent | fair |
| Side lobe performance with a parabolic reflector: | | |

-continued

| | SQUARE TAB | CIRCULAR TAB |
|---|---|---|
| VSWR | better than 1.22:1 | better than 1.22:1 |
| Off axis | poor | fair |

It should be noted that, unlike prior art impedance matching devices used to tune antenna assemblies, the tabs of the present invention are easily fabricated since they are an integral part of the wave guide and can be machined when the wave guide is constructed. Accordingly, the tabs of the instant invention provide improved performance characteristics and yet are easily and economically fabricated.

In summary, the addition of impedance matching tabs to the wave guide apertures of a Cutler antenna provides improved VSWR over a fairly broad band. The choice of rectangular or circular configurations for the tab depends upon the desired side-lobe performance of the antenna system.

Although the invention has been described in detail above, the invention is not to be limited thereby, but only in accordance with the spirit and scope of the appended claims.

What is claimed is:

1. A microwave antenna system comprising:

a. a concave reflective antenna member having a finite focus, said member being pivotable through a predetermined angle;

b. means for supplying microwave energy to, and for receiving microwave energy from said reflector, said means being positionally fixed relative to said member and including a splash plate having a pair of oppositely directed wing portions inclined toward said member, and a wave guide of generally rectangular cross section having a first input/output end penetrating said member, and a second end at the focus point of said member, said second end being in connected abutment with said splash plate, said wave guide defining a pair of apertures on opposite surfaces thereof, opening said wave guide toward said wing portions substantially at said abutment, therby forming means for focusing energy between said wave guide and said member via said apertures; and c. first and second impedance matching means, each being substantially coplanar with a different one of said opposite surfaces and each partially occluding an associated one of said apertures, said impedance matching means promoting the VSWR of said antenna system throughout the pivot range of said member.

2. A system as described in claim 1 wherein the short walls of said wave guide terminate in connected abutment with said splash plate, and the broad walls of said wave guide define said apertures to extend a predetermined distance from said splash plate toward said member.

3. A system as described in claim 2 wherein said impedance matching means each comprise metallic tab extensions from the broad walls of said wave guide across said apertures toward said splash plate.

4. A system as described in claim 3 wherein said tab extensions each include portions of a circle, extending into the associated apertures a distance less than the radius of said circle.

5. A system as described in claim 3 wherein said tab extensions each are rectangular in shape, narrower than said broad walls and shorter than said perdetermined distance.

* * * * *

UNITED STATES PATENT OFFICE

CERTIFICATE OF CORRECTION

Patent No. 4,058,812 Dated November 15, 1977

Inventor(s) David L. Stanislaw

It is certified that error appears in the above-identified patent and that said Letters Patent are hereby corrected as shown below:

Col. 1, line 42, change "Cutler" (second occurrence) to --feed--

Col. 3, line 58, change "atuomatic" to --automatic--.

Signed and Sealed this

Seventh Day of March 1978

[SEAL]

*Attest:*

RUTH C. MASON
*Attesting Officer*

LUTRELLE F. PARKER
*Acting Commissioner of Patents and Trademarks*